United States Patent [19]

Kole et al.

[11] 3,954,555

[45] May 4, 1976

[54] FIBER REINFORCED PLASTIC ARTICLES AND METHOD OF PREPARATION

[75] Inventors: Donald R. Kole, Cheektowaga, N.Y.; Walter E. Voisinet, Royal Oak, Mich.

[73] Assignee: National Gypsum Company, Buffalo, N.Y.

[22] Filed: Feb. 14, 1974

[21] Appl. No.: 442,673

Related U.S. Application Data

[63] Continuation-in-part of Ser. No. 293,742, Sept. 29, 1972, abandoned, which is a continuation-in-part of Ser. No. 760,828, Sept. 19, 1968, abandoned.

[52] U.S. Cl. ..... 162/136; 162/168 NA; 162/225

[51] Int. Cl.[2] ..... D21F 13/00

[58] Field of Search ..... 162/225, 416, 117, 136, 162/120, 168; 161/DIG. 3, 116, 56; 117/76, 155 VA, 92; 427/274, 276, 358, 370, 391, 393, 395; 428/142, 141, 156, 161, 165, 171, 174, 187

[56] References Cited

UNITED STATES PATENTS

| | | | |
|---|---|---|---|
| 3,113,065 | 12/1963 | Newton et al. | 162/225 |
| 3,455,779 | 7/1969 | Showalter | 162/225 |
| 3,542,641 | 11/1970 | Showalter et al. | 162/117 |
| 3,576,711 | 4/1971 | Baldwin | 162/206 |

*Primary Examiner*—S. Leon Bashore
*Assistant Examiner*—Peter Chin
*Attorney, Agent, or Firm*—Joseph P. Gastel

[57] ABSTRACT

A composition board consisting essentially of a resin binder in the amount of between about 10 and 45 percent by weight and filler materials in the amount of between about 90 and 55 percent by weight and having a cross section of varying depth formed as a result of differentially compacting a dry blank to a thickness which is between about 30 and 70 percent of the original thickness at an average pressure of between about 600 psi and 1500 psi at an elevated temperature which is between about 275° F. and 350° F. so as to cause portions which were compacted to a greater degree to exhibit a darker color than portions which were compacted to a lesser degree to thereby produce a tonal effect on said composition board.

20 Claims, 3 Drawing Figures

FIBER REINFORCED PLASTIC ARTICLES AND METHOD OF PREPARATION

This application is a continuation-in-part of application Ser. No. 293,742, filed Sept. 29, 1972 now abandoned, which in turn is a continuation-in-part of application Ser. No. 760,828, filed Sept. 19, 1968, now abandoned.

The present invention relates to an improved plastic board of the type having a grain with a tonal effect.

By way of background, in the past, certain fiber reinforced plastic sheets or boards, known as fiberboards, were fabricated with a textured surface in the nature of a grain. In those boards where it was desired that the grain have a tonal effect, that is, lighter and darker colored areas to simulate natural shading, a number of different methods were used during fabrication. One method was by painting the surface of the sheet with different shades of paint, as desired. Another method was by the selective placement of pigment within the board. Both of these prior methods were time consuming and costly, and the resulting coloration, or tonal effect, of the finished plastic sheet could not be controlled with any great degree of accuracy.

In addition, in the past it was desirable to apply a coating on the outer surface of a reinforced plastic sheet having a grain impressed therein for the purpose of giving the board a desired color and also for sealing the surface. This coating, in the past, was applied after the boards were pressed to their desired configuration, and this therefore constituted an additional step which increased the cost of production. In addition, because such boards had a grain impressed therein, it was difficult to apply the coating in a reasonably continuous film over the entire surface of the board because it inherently tended to run off of the ridges and accumulate in the valleys of the textured sheet. It is with overcoming the foregoing shortcomings experienced in the fabrication of fiber reinforced plastic sheets that the present invention is concerned.

It is accordingly one important object of the present invention to provide a fiber reinforced plastic sheet with a grain impressed therein so as to stimulate natural wood, with the grain possessing a natural shading or tonal effect wherein deeper portions of the grain are darker than less deep portions of the grain, and the darkness of the various portions of the grain varies generally proportionally to the depth of the grain, thereby providing the highly aesthetic appearance of the shading of a natural grain, with the tonal effect being achieved solely as a result of the impressing of the grain onto a board without any additional processing. A related object of the present invention is to cause the transition from lighter areas to darker areas to be extremely gradual, where this is desired, to further enhance the natural appearance and aesthetic beauty of simulated wood grain.

Another object of the present invention is to provide an improved reinforced plastic sheet having a grain impressed therein and with a continuous protective sealing coating on the grain of the board, with the coating being applied before the grain is impressed into the board and yet maintaining the continuous film notwithstanding that the board, after having been pressed, possesses cross sectional portions of different thicknesses. A related object of the present invention is to provide a coating on a grained board of the foregoing type wherein the coating fuses integrally with the substrate incidental to the pressing process. Other objects of the present invention will become more readily apparent hereafter.

The improved composition board of the present invention consists essentially of a resin binder and a filler and has a cross section of varying depth formed as a result of compacting a blank different amounts so as to cause portions which were compacted to a greater degree to exhibit a darker color than portions which were compacted to a lesser degree to thereby produce a shading or tonal effect on said composition board.

The present invention also relates to a process of making a reinforced plastic product comprising the steps of wet forming a resin binder-reinforcement material mixture, drying said mixture to form a blank, and thereafter pressing said dried wet-formed blank at an elevated temperature to increase the reinforcement material-resin bond and differentially compacting said blank so as to provide thicker portions and thinner portions so that said thinner portions exhibit a darker coloration than said thicker portions to thereby cause the finished reinforced plastic product to exhibit a shading as a result of said differential compacting.

The various aspects of the present invention will be more fully understood when the following portions of the specification are read in conjunction with the accompanying drawings wherein.

Figure 2:
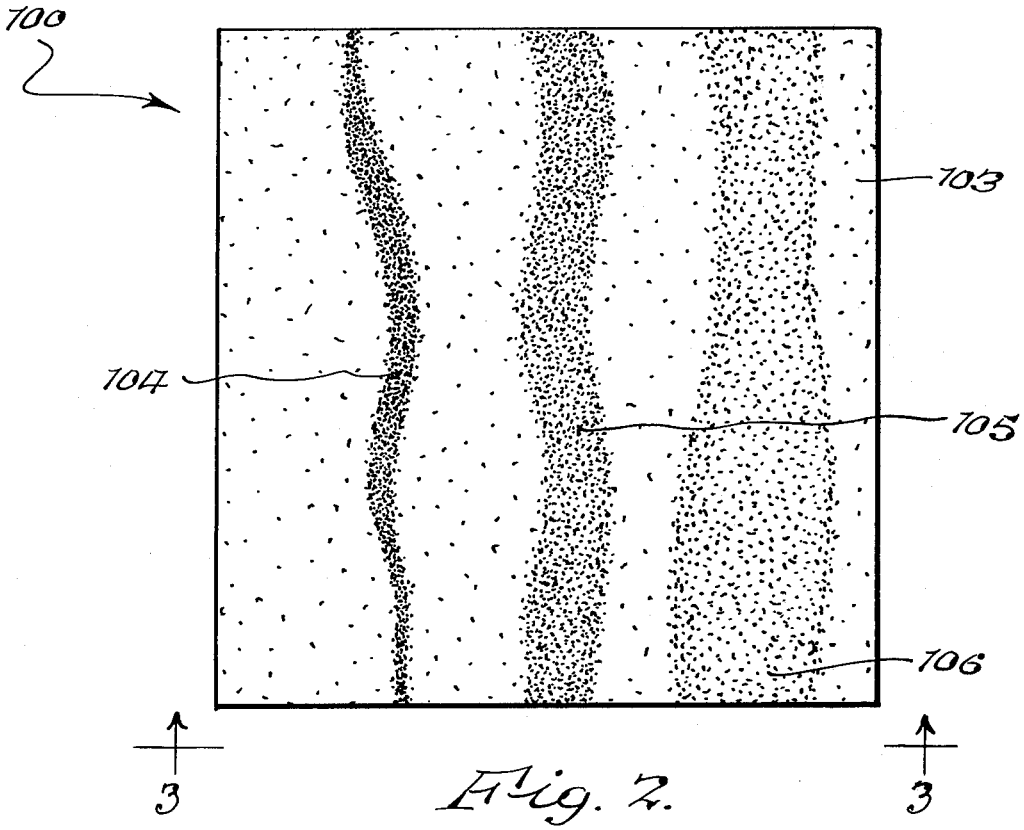
FIG. 2 is a fragmentary plan view of a sheet fabricated in accordance with the present invention and having a grain with a natural shading or tonal effect.
Figure 3:
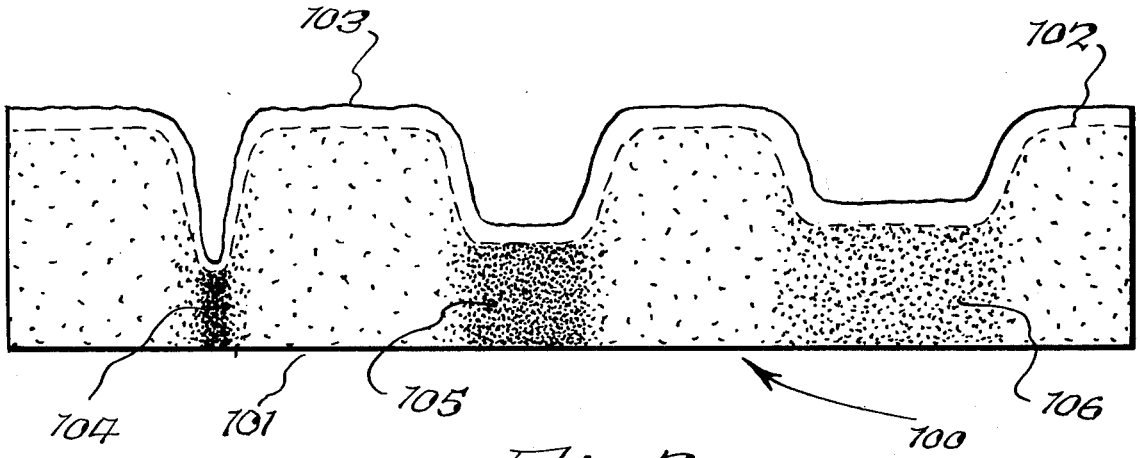
FIG. 3 is a view taken substantially in the direction of arrows 3—3 of FIG. 2.

The improved plastic sheet or board 100 of the present invention is shown in FIGS. 2 and 3 and it includes a lower planar surface 101 and an upper surface 102 in the nature of a wood grain, with a plastic coating 103 on the upper surface. As can be seen from a comparison of FIGS. 2 and 3, the board is of varying cross sectional dimension and it includes a very dark portion 104 which corresponds to the thinnest portion of the board, a less dark portion 105 which corresponds to a more thick portion of the board and a relatively light dark portion 106 which corresponds to a still thicker portion of the board. As can be seen from FIG. 3, portion 104 has been compressed more than portion 105, and portion 105 has been compressed more than portion 106, considering that the original blank was of a predetermined uniform thickness. More specifically, for example, in a certain sample the original blank before the wood grain was impressed therein had an uniform thickness of 0.200 inches. Portion 104, which is representative of the maximum compression, was compressed to a thickness of 0.062 inches. Portion 105, which is representative of a medium amount of compression, was compressed to a thickness of 0.082 inches. Portion 106, which is representative of a minimum amount of compression, was compressed to a thickness of 0.100 inches. Reductions of 69, 59 and 50 percent were thus respectively made. Thus the final thicknesses of portions 104, 105 and 106 were 31, 41 and 50 percent of the original thickness, respectively.

Certain of the portions of the board which do not have the pronounced darkening of areas 104, 105 and 106 were compressed from the original thickness of 0.200 inches to a thickness of 0.140 inches, for a 30 percent reduction. Where the transition zones from the thinner portions of the board to the thicker portions thereof are gradual, the change in shading will also be gradual, thereby providing an aesthetically pleasing appearance. It will be appreciated that boards can be compacted any desired amount between the limits of 30 to 70 percent of the original blank thickness, depending on the results which are desired. In addition, as will appear hereafter, the coating 103 of the board is applied before the pressing of the board to its desired wood grain finish and this coating has a final thickness of between 0.001 and 0.003 inches. The coating, before pressing, had a thickness of approximately 0.003 inches.

We have discovered that fiber reinforced plastic boards have a grain impressed therein are conveniently and economically made in a process wherein dried wet-formed sheets (hereafter sometimes referred to as blanks) of a mixture comprising about 10 to 45 percent by weight of a thermoplastic resin binder and about 55 to 90 percent by weight of the balance of the materials which includes reinforcing fibers and fillers is subjected to an elevated temperature of about 275° to 350° F. and a pressure sufficient to compress the various cross sectional portions of the sheet to a thickness which is 30 to 70 percent of its original thickness, and this will produce a tonal effect or a shading in the resulting sheet wherein the portions which are compressed more have a darker color than the portions which were compressed less, with the darkness being generally proportional to the amount of compression. When the grain pattern is that of natural wood, the shading or tonal effect very closely simulates the shading of natural wood.

The coloration or darkening achieved is a gray to black coloration starting with a blank which was off-white. The coloration permeates the entire board, that is, it is not merely a surface coloration, but extends entirely through the board from front to back, as is evident from FIG. 3. The intensity or tonal effect or shading as noted above varies from gray to black and is generally proportional to the pressure imposed on the board in the elevated temperature-compression step of the invention.

The duration of the aforementioned elevated temperature-compression step of the present invention will vary depending on the particular resin binder used and the reinforcing fiber. Generally however the hot pressing of the sheet is carried out for about one to five minutes, preferably for about two to four minutes. If convenient, the compressed resin may be cooled under the pressure utilized in the hot pressing operation.

The hot pressing step of the present invention is carried out in a platen press which compacts the dried wet-formed mixture of resin binder and reinforcing fiber. The compaction is preferably carried out with a platen embossed with a pattern, for example, ridges and grooves characteristic of a natural wood grain. During the impressing of the grain, the deeper portions of the pattern, namely, those portions which are on the portions of the sheet which are compressed more, are darker, as a result of a greater degree of compaction, than the less deep portions, namely, those portions which are compressed less. The resultant tonal effect is such that because of the variations in shading the resulting pattern is highly aesthetically pleasing because it possesses an appearance of great depth with the lighter sections merging uniformly into darker sections. It will be appreciated that in addition to impressing a wood grain, the present invention can also be used to impress a brick-like grain of a natural stone grain or any other type of grain which is desired, with the result that the more compacted portions of the sheet will have a darker shading than the less compacted portions of the sheet. The improved board of the present invention can be used for siding for mobile homes, exterior clapboard or shingles for regular homes, exterior Mansard type roofing, interior prefinished decorative panels, simulated brick or stone panels, panels for furniture and cabinetry, and other similar uses.

In preparing fiber reinforced plastic sheets having a grain impressed therein, it is preferable for certain applications to spray or otherwise uniformly coat the dried wet-formed blank prior to the hot pressing step with an aqueous polyethylene wax-acrylic emulsion-pigment primer-topcoat system. An acrylic emulsion component is applied as a primer coat to the dried wet-formed sheet, allowed to partially dry, and thereafter a topcoat containing an aqueous polyethylene wax plus the acrylic emulsion noted above plus a second acrylic emulsion plus an inert pigment extender is applied to the blank and thereafter dried. During the resulting compression by means of the patterned die, the coating remains continuous notwithstanding that different portions of the board have been subjected to different pressures. The polyethylene wax-acrylic emulsion-pigment system is thus evenly affixed as a veneer and fuses to the plastic sheet during the pressing operation, and effectively seals the plastic sheet against absorption of liquids such as water. By being able to apply the coating to the dried wet-formed blank it becomes unnecessary to add sealers or other additives of this type to the batch which is in the wet-forming machine, thereby simplifying operation of this machine. The coating may be of any desired color or tint and may be opaque or translucent. While a coating 103 has been shown on the board in FIGS. 2 and 3, it will be appreciated that the coating may be omitted for certain applications if desired.

In achieving the tonal effect in accordance with the present invention, the proportion of resin binder to reinforcing fiber and filler in the blank should be between about 10 to 45 percent by weight and preferably the resin content should be between about 15 to 40 percent by weight and more preferably between about 20 to 35 percent by weight. While the temperature of the elevated temperature compression step is generally 275° F. to 350° F., preferably the temperature of the hot pressing step should be between 300° F. to 340° F. The percent of reduction of the patterned board, while normally ranging between 30 to 70 percent of the original thickness of the blank, is preferably between about 50 to 70 percent of the original thickness. Generally the average pressure applied to the entire board during the compaction step is between 600 to 1500 psi.

The primary resin binder is a thermoplastic. Typical thermoplastics useful as resin binders in the process of the invention include the following representative examples:

Polyvinyl chloride homopolymers (such as polyvinyl chloride homopolymers commercially available as proprietary aqueous emulsions under the trade name Geon 151, from the B. F. Goodrich Chemical Co. and the dry powder polyvinyl chloride homopolymer known by the trade name Geon 121 marketed by the B. F. Goodrich Chemical Co.)

Polyvinyl chloride-polyvinyl acetate copolymers known by the trade name geon 470X2 of the B. F. Goodrich Chemical Co.

Polyvinyl chloride-acrylic copolymers such as the Geon 351 and Geon 350X31 which are proprietary emulsions marketed by the B. F. Goodrich Chemical Co.

Polyvinyl chloride-polyvinyl acetate maleic acid copolymers known under the trade name Pliovic MC-85 which is a powdered dispersion grade vinyl chloride-maleic ester copolymer resin manufactured by the Goodyear Chemical Co.

Vinyl chloride propylene copolymer known by the trade name Airco 400 series which is propylene modified polyvinyl chloride resin powder manufactured by the Airco Chemical and Plastic Co.

Extracted pure wood pitch resin which comprises a residue low in abietic acid remaining after the separation of refined rosin high in abietic acid from the resinous material obtained by extraction of pure wood with a solvent. A commercial variety of such resin is commercially available under the trade name VINSOL from Hercules, Inc.

Mixtures of the foregoing and equivalent thermoplastic resins can be used also. Preferably the resin employed as a binder in the invention is a polyvinyl chloride homopolymer or copolymer.

In accordance with an optional embodiment of the invention the resin binder component contains a small amount, say from about 1 to 10 percent and preferably about 5 to 8 percent by weight of the total weight of resins of a medium polyacrylonitrile rubber latex of the type marketed under the trade name HYCAR by the B. F. Goodrich Chemical Company as exemplified as HYCAR 1512, 1552, 1562 and 1562X117. This optional additive provides lower foaming in the wet formulation process, described hereafter, allows for greater machine speed and ultimately produces a finished fiber reinforced plastic sheet or board of lower moisture absorption. Other suitable medium polyacrylonitrile rubber latex additives are described in the phamphlet "Latexes" published by the B. F. Goodrich Chemical Co.

The polyethylene wax emulsion portion of the coating, according to a preferred embodiment of the invention, consists of proprietary low opacity transparent aqueous emulsions of the type utilized heretofore in the prior art as components for polishes or sealers for household plastics such as linoleum. The polyethylene wax emulsion components of the coating materials are pH-stable aqueous anionic polyethylene emulsions of the type exemplified by the proprietary compositions available commercially under the trade name POLYEM from Cosden Oil and Chemical Company.

Typical suitable acrylic emulsions form part of the coating include those known under the trade name RHOPLEX, that is RHOPLEX B-85, which is discussed in the phamphlet "Formulating Floor Polishes with RHOPLEX Emulsions" published June 1969 by the Rohm and Haas Company. The primer coat is preferably RHOPLEX AC-61, and the topcoat is a mixture of RHOPLEX AC-61, RHOPLEX B-85, the POLYEM, and an inert extender pigment. Since the primer coat and topcoat are conveniently applied in the present process by spraying, they advantageously should have a relatively low solids content, say of about 20 to 25 percent by weight.

The reinforcing materials and fillers employed in the process of the invention include the conventional inorganic, i.e. mineral and organic substances conventionally used as reinforcing fibers and fillers for preparing reinforced plastic boards and sheets. Typical representative classes of such materials include:

1. Low density reinforcing fibers such as cellulosic fibers, e.g. pressure refined wood pulp, newsprint pulp and Kraft pulp.
2. Fire resistant reinforcing fibers such as glass fiber or asbestos conventionally milled for reinforcement as exemplified in 5R-1 and 6D-1 size asbestos.
3. High bulk low density, low cost reinforcing mineral fillers such as silica, diatomaceous earth, vermiculite and perlite, e.g. the perlite mineral filler containing 76% $SiO_2$; 14% $Al_2O_3$; 4.6% $K_2O$; 2.9% $Na_2O$; 0.44% CaO; 0.06% $Fe_2O_3$; and 0.04% MgO marketed under the trade name Sil Flo Grade 909 by the Sil Flo Corporation. Advantageously for reasons of economics and convenience all three above types of fibers and fillers are utilized as the reinforcing material in the present invention. Desirably about 10% of the entire mass is Kraft pulp or other cellulosic fiber or other low density fiber, about 25–50 percent by weight is asbestos or other fire resistant fiber, and about 15–40 percent by weight is perlite or other high bulk mineral filler or fiber. Advantageously the asbestos component contains 6D-1 asbestos and 5R-1 asbestos in a weight ratio of 1.5:1 to 1:1, and especially in a weight ratio of about 1.4:1.

In addition to the grey to black colorations imparted by the novel method of the invention, it is usually desirable to impart to the reinforced plastic sheeting an uniform supplementary coloration such as brown coloration to simulate the color of wood. The supplementary coloration can conveniently be imparted to the sheets or boards by dispensing about 0.2 to 0.5 percent by weight of a water insoluble inorganic or organic pigment in the polyethylene wax acrylic topcoat which is applied to the reinforced plastic sheet prior to the hot pressing step. Alternatively, the pigment can be charged with the reinforcing material in the sheet fabrication process and typical examples of suitable pigments include:

1. ST-1065, Burnt umber aqueous dispersion pigment manufactured by Stabiloid, Inc.
2. ST-813, Green aqueous dispersion pigment, manufactured by Stabiloid, Inc.
3. ST-949, Red aqueous dispersion pigment, manufactured by Stabiloid, Inc.
4. G-4099, Chromium oxide green pigment, manufactured by Pfizer Minerals, Pigment and Metals Division.
5. R-5098, Red oxide pigment, manufactured by Pfizer Minerals, Pigment and Metals Division.

The fiber reinforced plastic sheet blanks of the present invention can be conveniently and economically made by a wet-forming process and such a process offers many advantages over the methods heretofore known. The processing costs are relatively low due to the rapid production rates which can be achieved on a wet-forming machine. The sheets can be made on existing wet-forming machinery without the necessity of making any major modifications on it for this purpose. Substantially all of the fibers will be disposed in directions which are in the plane of the sheet thus deriving substantially the maximum reinforcing value from the fibers. While the primary fiber orientation is in the machine preparation direction, the fibers are nevertheless randomly distributed in all directions which are in the plane of the sheet. This arrangement of the fibers gives the sheet some degree of uniformity in its physical properties in these directions thus lessening any strains present in the sheets and giving them relatively good dimensional stability characteristics. Large amounts of fiber can be incorporated in the sheets made by this process. The maximum amount that can be used in any formulation is generally limited only by the consideration that there must be enough resin present to fuse the mass of fibers together. Fibers of relatively long lengths can be employed since they are not fractured during processing. Taking all of these factors into consideration it can be seen that this wet-forming method is capable of achieving a significant reduction in the cost of fiber reinforced sheets, which sheets at the same time will have overall physical properties which are superior to those of similar sheets made by the other methods currently known.

Figure 1:
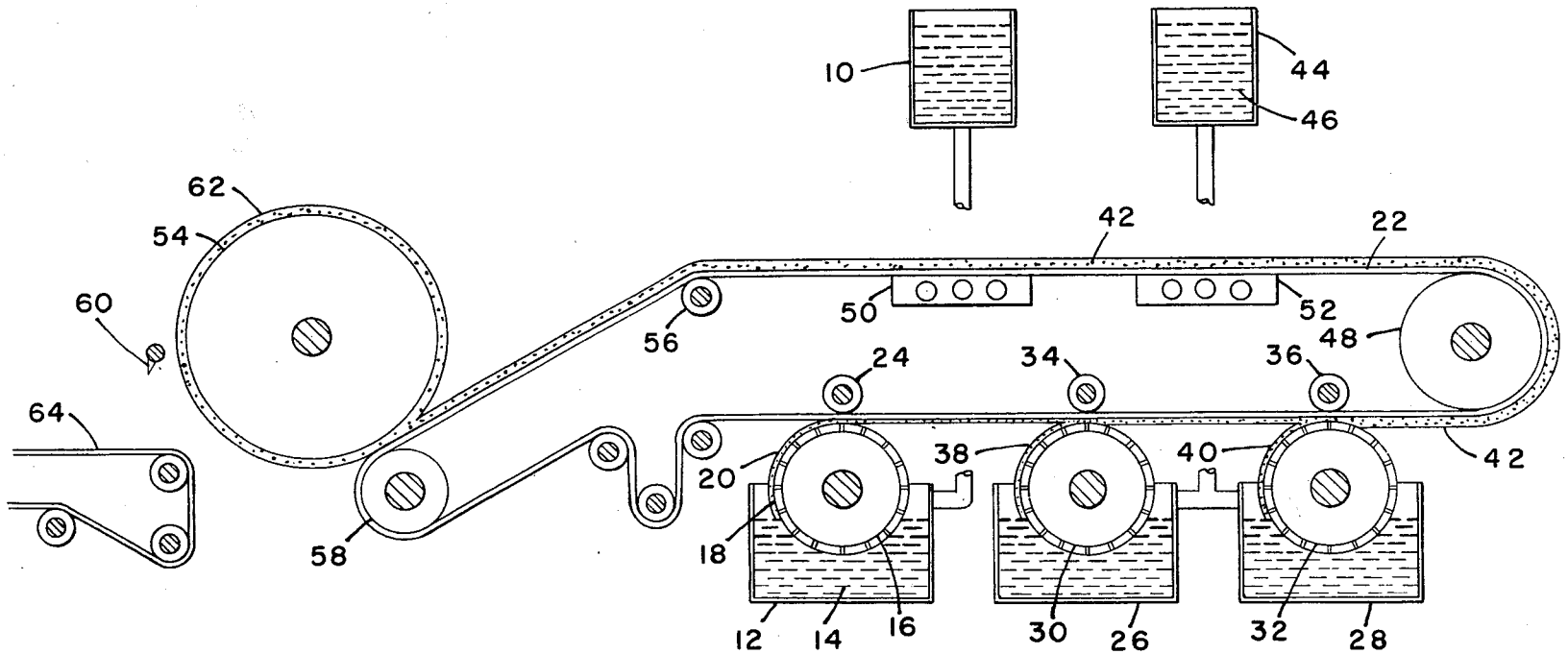
FIG. 1 is a diagrammatic representation of a Hatschek wet forming machine used to fabricate blank sheets which are subsequently impressed with a grain having a natural shading or tonal effect in accordance with the present invention.

The preferred wet-forming apparatus which is applicable for use within the scope of this invention is a Hatschek machine. Referring to FIG. 1, a stock chest 10 supplies a mold 12 with an aqueous slurry 14 of the composite material, the solids of which contain between about 10–45 percent by weight of thermoplastic binder and between about 55–90 percent by weight of reinforcing fibers and fillers, for a total of approximately 4 to 9 percent solids with 6 percent solids being preferred, the remainder being water. A cylinder 16 having a screen 18 around its periphery rotates in the mold 12 and picks up a layer of material 20 from the slurry 14. The layer of material 20 is then deposited on the underside of the endless moving felt 22 opposite the pressure roll 24. Where it is so desired additional molds and cylinders may be provided to build up a thicker layer of the composite material on the felt. For purposes of illustration two other material pick-up stations comprising molds 26 and 28, cylinders 30 and 32 and pressure rolls 34 and 36, respectively, are shown. This equipment functions in the same manner as the similar equipment described above except the layers of material 38 and 40 picked up by the cylinders 30 and 32, respectively, are transferred to the underside of the felt 22 or to the underside of the layer of material 20 previously deposited on the felt by the cylinder 16 forming a multi-ply web 42. In one of the modes of practicing this invention another stock chest 44 is filled with a slurry 46 of a different composite material than that contained by the other stock chest 10. This slurry 46, for example, is fed into molds 26 and/or 28 and the procedure is carried out as previously described giving a multi-ply web 42 having plies of differing composite materials.

As the felt 22 reverses direction around a roll 48 the composite material 42 adhered to the felt becomes disposed on the upper side thereof and the water drains by gravity from the material through the felt. To assist in removing additional water, vacuum boxes 50 and 52 are positioned underneath the felt as it moves toward the accumulator roll 54. The felt travels over the transition roll 56, between the accumulator roll 54 and the opposition roll 58 and back toward the mold 12 to pick up more material. The layer of material on the felt 22 is transferred to the accumulator roll 54 as it is subjected to the pressure exerted by the accumulator roll and the opposition roll 58; the layer of material 42 readily adheres to the accumulator roll or to a previous wrap of material as the case may be. Any reasonable numer of layers of material may be built up on the accumulator roll. When the desired thickness of material on the accumulator roll has been reached, a knife 60 is actuated and a formed sheet 62 is transferred to a conveyor 64 which takes the sheet 62 to other locations to undergo further processing.

At this stage a typical sheet contains about 40 percent water and is quite weak since the resin binder has not yet been fused to the other components. The sheet is held together by the interlocking action of the fibers dispersed throughout the structure. The remainder of the residual water is removed by drying the sheet in an oven. The temperature and duration of this drying operation must be carefully controlled so as not to decompose the resin binder. Preferably, a sheet which is 0.100 inches thick is dried at a temperature of between about 220° F. to 320° F. for a period of about fifteen minutes. Further, it is important that all of the water be removed in this operation so that the sheet will not blister during final processing.

The dried sheet or blank is then ready for processing into its final form wherein it has a textured surface of the type under consideration here. This can be accomplished by preheating it to the fusion temperature of the resin binder, of approximately 330° F., and passing it through a roll type press at a rate and nip pressure, of approximately 1000 psi, such that the sheet is in contact with the rolls long enough to effect permanent compaction of the composite material. Preferably, however, the sheet is hot pressed in a platen press at conditions which will be sufficient to fuse the components together. The temperature and pressure at which the drying and pressing operations are carried out and their duration are dependent upon the resin binder present, the thickness of the sheet and the amount of preheating applied as mentioned above and more fully described in the examples further below. After having undergone final processing the resin binder is completely fused to the other components and the sheet takes on its maximum physical properties. It is then cooled and stored.

The fiber reinforced plastic sheets made by this wet-forming method possess very good dimensional stability characteristics. This can be seen from a comparison of the thermal expansion values for such sheets with those of unreinforced plastic sheets made by another process. For example, a reinforced polyvinyl chloride sheet made by this process had a thermal expansion value of $7 \times 10^{-6}$ in/in/°F over a temperature range of 72°–220° F compared to $3 \times 10^{-5}$ in/in°F over the same range for a typical unreinforced polyvinyl chloride sheet made by an extrusion process.

EXAMPLES I –IV

The fibers which are appropriate for use within the scope of this invention are asbestos, glass and other synthetic or natural fibers or mixtures thereof, as noted more fully above. The maximum reinforcement — resin ratio which can be achieved will vary to some extent with the individual fibers as well as the characteristics of the different resins. Sheets have been prepared containing as much as 90 percent by weight of reinforcing fiber, such as asbestos fiber. Table 1 shows the strength properties of sheets made from formulations containing varying amounts of resin and fiber. These sheets were made by first forming an aqueous slurry of the fiber and resin along with an anti-foaming agent and a coagulating agent to aid in processing. The slurry was poured into a 12 × 12″ vacuum mold where the sheets were formed and most of the water removed from them. They were then placed in an oven at a temperature of 220° F. for about three to four hours to dry them completely. The oven used was a two-zone gas-fired hot air oven manufactured by the Jensen Corp. Final processing was accomplished by pressing them in a heated platen press at 320° F. for about three to four minutes at a pressure of 700 psi. The platen press which was used with a Reliable hydraulic platen press, 2200 ton capacity, having a 30 × 30 inch platen size and manufactured by the Reliable Press Co., Inc.

The resin used in these sheets is known by the trade name Geon Latex No. 352, a product of the B. F. Goodrich Company. It is a polyvinyl chloride copolymer latex emulsion with a 56 percent solids content. 4T-1 unopened asbestos fiber was used as the reinforcement. The results shown are the average of eight determinations.

TABLE 1

| EXAMPLE | % FIBER (BY WEIGHT) | %RESIN SOLIDS (BY WEIGHT) | THICKNESS INCHES | IMPACT FT-LBS/IN² | TENSILE STRENGTH PSI |
|---|---|---|---|---|---|
| I | 90 | 10 | 0.070 | 3.437 | 1420.1 |
| II | 85 | 15 | 0.061 | 4.645 | 2911.7 |
| III | 80 | 20 | 0.064 | 4.286 | 3862.9 |
| IV | 75 | 25 | 0.056 | 6.249 | 3485.6 |

Fiber reinforced plastic sheets made in accordance with this invention may include a high-bulk fibrous filler, namely pressure refined wood fiber, which will provide an advantage during processing of the sheets and also lower their density without causing a proportional loss in their strength. This fiber, characterized by its extreme freeness, which means that it has excellent water drainage properties, increases the water drainage rate of the composite material during processing thereby permitting faster production rates. Since it is a high bulk low density material it is primarily used to lower the density of the finished sheet. As a general rule the density of these reinforced sheets and their strength are directly related so that as their density is decreased a proportional loss in strength will result. However it has been found that this wood fiber functions to some extent as a reinforcing agent such that the decrease in density which occurs when it is incorporated in the formulation is not accompanied by as large a loss in strength as would otherwise be the case where, for example, a high bulk, low density, inorganic mineral filler were used to lower the density. It has been found that from about 5 percent to about 80 percent by weight of this fiber in a reinforced plastic sheet will give a product exhibiting superior physical properties when compared to sheets in which low density, high bulk inorganic mineral fillers are employed to lower their densities. This wood fiber may be used alone with a resin or in combination with other reinforcing fibers and/or inorganic mineral fillers.

In contrast to standard wood fibers which are normally made from wood chips by either mechanical action or a combination of chemical and mechanical action, the pressure refined wood fiber is processed by placing the wood chips in a refiner under steam pressure. The physical characteristics of the fibers are determined by the level of pressure applied, the positioning of the refiner plates and the duration of the processing cycle. Preferably the pressure refined wood fiber used in these sheets is made from pine wood chips and is processed for about two to about six minutes in a refiner such as a Bauer Bros. 410 Refiner under a pressure in the range of from about 10 to about 150 psi with a plate setting of from about 0.015 to 0.050 inches resulting in a fiber which has a Freeness value of from about three to about ten seconds when tested according to T.A.P.P.I. Test Method T-1002. Both the wood fiber processing equipment and the wood fibers themselves are available from Bauer Bros., Springfield, Ill.

Forming the sheets on a Hatschek machine allows sheets of a desired thickness to be made by forming successive layers of the same composite material, wrapping them around the accumulator roll over one another until the desired thickness is reached and then removing the sheet from the roll. The maximum thickness of the sheets that can be formed successfully in this manner is dependent upon the circumference of the accumulator roll. As the successive wraps of material are wound around the roll their lengths become increasingly longer. Thus, when the integral sheet is removed from the roll there are strains between the individual layers at the ends of the sheet due to the differing lengths of the layers.

One of the outstanding features of this procedure is that integral sheets which have one or both of their outer surfaces formed by veneer composite material can be made in a continuous operation. This can be accomplished by placing in one mold, a formulation of composite material which will be referred to as the core formulation and which is intended to form the inner part of the integral sheet while another formulation of composite material, which will be referred to as the veneer formulation and which is intended to form the outer part of the integral sheet, is placed in another mold. A layer of the veneer composite material is then deposited on the felt and wrapped around the accumulator roll followed by one or more layers of the veneer composite material. The integral sheet formed in this manner will have the veneer composite material bonded to the core composite material in the same manner as the components of each composite material are bonded to each other, that is, by resin fusion since both composite materials contain resin binder.

A veneered sheet formed by this process is preferable to sheets made by other processes where veneer materials, mainly used for decorative purposes, must be affixed to the reinforced plastic sheets by adhesives. In the prior sheets the veneer material usually adds nothing to their strength properties. In the wet-forming process the veneer sheet itself will normally be stronger than the individual core sheets since the former preferably contains only the resin binder and the reinforcing fibers and the core sheets have fillers. When the stronger veneer sheets are bonded to one or both sides of the weaker core sheets a stiffening action takes place giving added rigidity to the integral sheet. A further advantage of sheets formed in this manner is that their strongest areas are the outer surfaces which will, during use, be required to withstand the strongest impacts.

The veneer composite material, in addition to the resin binder and reinforcing fibers, will contain pigments and other additives to impart properties such as color, flame resistance, resistivity to chemicals and the like to the sheet. The core composite material will preferably be made up of the resin binder and reinforcing fibers with inorganic filler materials and pressure refined wood fiber being added to lower cost and density where appropriate. Preferably the composite material from which the core sheets are made should have as low a cost as is possible while at the same time being capable of giving the integral sheets the properties necessary for them to perform their required function.

The following examples illustrate formulations which have been used to make core and veneer sheets. All parts listed are by weight.

EXAMPLE V

A core composite material was prepared by first adding 37.5 parts of a fine silica filler material, 12.5 parts of pressure refined wood fiber and 25 parts of asbestos fibers to 900 parts of water with moderate agitation from a mixer for about five minutes. The asbestos fiber content was made up of equal parts of opened 4T and opened 6D chrysotile fibers. Next 45.5 parts of Geon Latex No. 351, a polyvinyl chloride copolymer latex emulsion resin made by B. F Goodrich Company having a 56 percent solids content, were added with further moderate agitation. Then 0.1 part of Reten 210 (100 ml of a 0.1 percent by weight aqueous solution), a flocculating agent, was added with very mild hand stirring, The Reten 210 is a cationic, high molecular weight, synthetic, water soluble copolymer of acrylamide and betamethacrylyloxyethyltrimethylammonium methyl sulfate made by Hercules, Inc. It was necessary to exercise caution when stirring the slurry at this point for if it was stirred too vigorously the flocculation of the materials would tend to break down. Should this occur the sheet made from the slurry would not be uniform and the finished product would have significant physical property variations. The slurry was then diluted to its formulated solids content of about 5 percent by adding 1000 parts of water.

The slurry was poured into a vacuum mold where the sheet was formed and most of the water was removed. The sheet was then inserted in a 3 × 8 inch die which was placed in a hydraulic press at 400 psi in order to remove more water. The sheet was removed from the die, placed in an oven at a temperature of 220° F. to remove the remaining water and then hot pressed into its final form at 320° F. and 800 psi for about four minutes. The finished sheet had a density of about 60 pounds per cubic foot.

EXAMPLE VI

A veneer composite material was prepared by first adding 57.2 parts of asbestos fiber consisting of equal parts of opened 4T and opened 6D chrysotile fibers 3 parts pigment and 0.5 part of an ultra-violet stabilizing agent, these latter two components having previously been mixed together, to 900 parts of water with moderate agitation from a mixer for about five minutes. Next 72.8 parts of Geon Latex No. 351 were added followed by 0.5 part of a heat stabilizing agent and 0.1 part of an anti-foaming agent in that order with continued agitation. Finally 0.1 part of Reten 210 (100 ml of a 0.1 percent by weight aqueous solution) was added with very mild hand stirring and 1000 parts of water poured into the slurry to bring it to its desired solids content of about 5 percent. The veneer sheet was made from the slurry by the same procedure as was shown above. It had a density of about 90 pounds per cubic foot.

It will be understood that the materials and amounts cited in the examples are intended to be illustrative only and changes may be made within the scope of this invention.

EXAMPLE VII

A further procedure which may be utilized with the wet-forming method in order to achieve certain desirable objectives is that of post-lamination of individual sheets after they have been formed on and removed from the wet-forming machine. This post-laminating procedure contemplates the formation of core and veneer sheets separately on the wet machine and storing them after they have been removed from the accumulator roll and dried. They can then be kept as a stockpile from which the manufacturer can fill orders for a variety of integral sheets having widely varying costs and physical properties by fusing various combinations of the sheets together in the hot pressing operation.

Core sheets having even greater thicknesses than those which are manufactured on the wet machine in one continuous operation can be made by pressing two or more individual core sheets together at the fusion temperature of the resin binder to effect permanent compaction of the sheets. It can readily be seen that sheets of substantial thicknesses may be obtained by the use of this procedure. This feature can be used to great advantage where the sheets are intended for use in structural applications such as wall panels and the like where it is desirable to have sheets of substantial thickness. In the same hot pressing operation, if it is so desired, the sheet being formed can be made to have one or both of its outer surfaces formed by the veneer composite material. This is done by placing the individual veneer sheet or sheets in the press along with the individual core sheet or sheets so as to give the desired construction.

This post-lamination procedure can also be utilized to make fiber reinforced plastic sheets having a unique property, that is, having substantially equal physical properties in the directions in the plane of the sheets which are parallel with and perpendicular to the machine preparation direction. For example, two core sheets having substantially the same thickness and physical properties can be placed in the press so that their respective directions of greatest strength lie in horizontal planes which are perpendicular to each other. Further, integral sheets which are veneered on one or both sides and which have substantially equal physical properties in the directions in the plane of the sheets which are parallel with and perpendicular to the machine preparation direction can be formed by combining individual core and veneer sheets of thicknesses and strengths in such a manner as to give the desired result.

Two 12 × 12 inch core sheets having thicknesses of about 0.20 inch which had previously been formed from the same slurry of composite material in the same manner previously described and dried but which had not been processed into final form were hot pressed together at 320° F. under a pressure of 800 psi for about four minutes. They were placed in the press in a manner such that their respective directions of greatest strength, that is, their machine preparation direction, were parallel to each other. This integral sheet is identified as Sheet A. Sheet B was prepared from two individual sheets identical to those that were used to make Sheet A and processed under the same conditions except that the individual sheets were placed in the press so that their respective directions of greatest strength lay in horizontal planes which were perpendicular to each other. The strength properties of these sheets are shown in Table 2.

TABLE 2

| | SHEET A | | SHEET B | |
|---|---|---|---|---|
| | TENSILE PSI | IMPACT FT-LBS/IN² | TENSILE PSI | IMPACT FT-LBS/IN² |
| PARALLEL TO MACHINE PREPARATION DIRECTION | 4803.4 | 4.96 | 3808.5 | 4.58 |
| PERPENDICULAR TO MACHINE PREPARATION DIRECTION | 3103.7 | 4.03 | 3723.8 | 4.53 |

The integral sheets formed by the post-lamination procedure may be given a textured surface at the same time the sheets are being pressed together by using a textured plate in the platen press. In texturing the sheets during this operation the necessity of doing so in another step is eliminated and the processing costs can consequently be further reduced. In addition to producing substantially flat sheets with this wet-forming process it is also possible to conveniently make products having various contoured shapes. This can be done, for example, by carrying out the final pressing operation in a press having contoured rather than flat plates. In this manner products such as corrugated sheets and the like having substantially uniform thickness throughout and having the properties of any of the various combinations of core and/or veneer sheets previously described can be produced.

Thermoplastic resins including among others polyvinyl chloride homopolymers, polyvinyl chloride copolymerized with acrylics, polyvinyl chloride copolymerized with polyvinyl acetate, polyvinyl chloride — polyvinyl acetate — maleic acid copolymers and polyethylenes are suitable for use as binders within the scope of this invention. Further, the resins which are employed as binders can be either in the dry dispersible powdered form or the latex emulsion form or mixtures thereof, but the latexes are preferred.

EXAMPLE VIII

A reinforced plastic sheet was prepared from the components listed below. On completion of the drying step the resin-reinforcing material mixture was subjected at 330° F. for 1.5 minutes at an average pressure of 1250 psi exerted from a platen textured to impress a simulated wood grain. The initial thickness of the blank was 0.200 inches and the final thickness of the blank after compaction in the platen press varied between 30 and 70 percent of the thickness of the original dried, wet-formed blank. The impressed pattern on the plastic sheet product was distinctly enhanced and highlighted by the grey to black colorations or tonal effect produced by the compaction, with the more compacted portions being darker than the less compacted portions, as shown in FIGS. 2 and 3.

| PARTS BY WEIGHT | COMPONENTS | ACTUAL WEIGHT | DRY SOLID WEIGHT |
|---|---|---|---|
| 25 | Geon 350 × 31 (51.6%) | 485 lbs. | 250 lbs. |
| 2 | Hycar 1562 × 117 (41%) | 49 lbs. | 20 lbs. |
| 10 | Kraft Pulp | Solids dependent | 100 lbs |
| 18 | 5R-1 Asbestos-Fiber | 180 lbs. | 180 lbs. |
| 25 | 6D-1 Asbestos-Fiber | 250 lbs. | 250 lbs. |
| 20 | Sil Flo (perlite) (Grade 909) | 200 lbs. | 200 lbs. |
| | | | 1000 lbs. |

The Geon 350 × 31 is a polyvinyl chloride-acrylic copolymer (B. F. Goodrich Chemical Company). The Hycar 1562 × 117 is a medium butadine polyacrylonitrile rubber latex (B. F. Goodrich Chemical Company). The Sil Flo is a perlite mineral filler (Sil Flo Corp.).

In order to prepare a reinforced plastic sheet of the above composition in the plant the following procedure is followed:

Fill mixing tank (cone tank) with approximately 10,000 lbs. of 105° F. water and while agitating by recirculating with a centrifugal pump add 180 lbs. of 5R-1 asbestos fiber, 250 lbs. of 6D-1 asbestos fiber and 200 lbs. of Sil Flo which had been previously dry blended in a suitable mixer. Continue agitating for a few minutes and then slowly add 485 lbs. of Geon 350 × 31 latex and 49 lbs. of Hycar 1562 × 117 latex which had been previously combined. Agitate for about four minutes and then add 100 lbs. (dry weight) of Kraft pulp which had been previously pulped at a 3 percent consistency. The stock can be transferred from the cone tank into a stock agitator chest to be subsequently transferred to the wet machine to be formed into sheet stock. The stock agitator chest is a bucket type mixer with paddle agitation which forms a part of the Hatschek machine described above. Prior to the time that the stock enters the cylinder molds from the stock chest, Reten 210 is added by spraying into the feed duct therebetween at a ratio of between ¼ to 1 pound of Reten 210 solids per ton of stock. As noted above the Reten 210 functions as a fluocculent to enhance drainage and stock retention. The wet blanks are dried at a temperature of 275° F. – 300° F. until dried to bone driness.

The following formulations were made in accordance with the procedure of Example VIII, except when Pliovic MC-85 and Vinsol were used, they were added with the dry powders because they are dry powder resins themselves. All data is presented in percent by weight.

| COMPONENTS | EXAMPLE IX | EXAMPLE X | EXAMPLE XI |
|---|---|---|---|
| | PERCENT BY WEIGHT | | |
| Geon 350 × 31 | 28 | 18 | 18 |
| Hycar 1562 × 117 | 2 | 2 | 2 |
| Pliovic MC-85 | — | 10 | 7.5 |
| Vinsol | — | 5 | 7.5 |
| (Total Resin Content) | 30 | 35 | 35 |
| Kraft Pulp | 10 | 10 | 10 |
| 5R-1 Asbestos | 20 | 20 | 20 |
| 6D-1 Asbestos | 25 | 20 | 20 |
| Sil Flo (perlite) (Grade 909) | 15 | 15 | 15 |

EXAMPLE XII

| PARTS BY WEIGHT | COMPONENTS | ACTUAL WEIGHT | DRY SOLID WEIGHT |
|---|---|---|---|
| 33 | Geon 350 × 31 (54%) | 30.6 g. | 16.5 g. |
| 2 | Hycar 1562 × 117 | 2.4 g. | 1.0 g. |
| 10 | News Pulp | 5.0 g. | 5.0 g. |
| 20 | 5R-1 Asbestos-Fiber | 10.0 g. | 10.0 g. |
| 20 | No. 3 Paperbestos-Fiber | 10.0 g. | 10.0 g. |
| 15 | Sil Flo (perlite) (Grade 909) | 7.5 g. | 7.5 g. |
| | | | 50.0 g. |

To make the board of Example XII the following steps were performed. Combine asbestos-fibers and Sil Flo and add to 1000 cc of 110° F. water while mixing with a Lightnin mixer in a 2 liter glass beaker. To this slurry, add the previously combined Geon 350 × 31 and hycar 1562 × 117 latexes. Mix at a moderate speed until the latexes are deposited onto the fiber. This will occur in 4–8 minutes and is apparent when the slurry turns clear from its original milky (cloudy) appearance. The paper pulp is then added and mixed until the slurry is uniform. The slurry is then diluted with 650 cc. of 110° F. water and agitation is slowed to a minimum mixing speed. The slurry solids are approximately 3 percent at this point. 20 cc of a 0.1 percent solution of Reten 210 is then added slowly while mixing continues to floc the slurry to improve solids retention and increase drainage rates. (20 cc of Reten 210 at 0.1 percent solids in 50 g. of stock solids is equivalent to 0.8 lbs. of Reten 210/ton of slurry.) This mixing is brief and mild and is effected for about one-half minute. The slurry is then poured into a 3 × 8 inch vacuum box to remove the major part of the water. A ratio of 1:1 of solids to liquid remains in the sample at this point. It is then removed from filter box and it is put into a 3 × 8 inch form where it is pressed with a total force of 10000 pounds ( 420 psi) for about 10 seconds to reduce the moisture content in the sheet to about 30 percent and to obtain sheet integrity. The sheet is removed and dried at about 220° F. for about one hour, but this can be dried to bone dryness. The dried sheet is pressed in a textured platen press to obtain desired density and surface configuration. The bone dry sample was originally 0.130 inches thick and the platen pressing operation reduced it to an average thickness of 0.085 inches. Reductions of the original dry sample ranged between 30 and 70 percent of the original thickness. The coloration of the textured board varied between light grey and dark grey with a pronounced tonal effect resulting from the different degrees of compaction, with the more compacted portions being darker than the less compacted portions.

A preferred prime coat mixture for the improved board of the present invention consists of

| Materials | Lbs. |
|---|---|
| Rhoplex AC-61 | 442.0 |
| Water | 176.0 |
| 5% QP-40 Solution | 35.0 |
| Super AD-it | 1.0 |
| | 654.0 |

The RHOPLEX AC-61 is a thermoplastic acqueous acrylic emulsion polymer containing approximately 46–49 percent solids and manufactured by the Rohm and Haas Company, as noted above. It has a pH of 9.5–10.0 and weighs approximately 8.85 pounds per gallon. Similar compositions are disclosed in U.S. Pat. No. 2,795,564. It provides a clear film having an ultimate hardness of 1.2 on the Tukon scale.

The QP-40 is a thickener comprising hydroxyethylcellulose and is manufactured by Union Carbide Company.

The Super AD-it is a preservative fungicide comprising di (phenyl mercury) dodecenyl succinate.

A preferred topcoat base mixture which has been formulated and to which polyethylene wax emulsion is subsequently added consists of

| Materials | Lbs. | Approximate % By Weight |
|---|---|---|
| Water | 151.0 | 13.5 |
| Tamol 850 | 6.0 | .5 |
| TK-100 | 2.0 | .2 |
| Merbac 35 | 1.0 | .1 |
| Duramite | 350.0 | 31.5 |
| Rhoplex AC-61 | 368.0 | 33.0 |
| Rhoplex B-85 | 157.0 | 14.0 |
| 5% QP-40 Solution | 84.0 | 7.5 |
| Tint | as required | |
| | 1119.0 | |

The Tamol 850 is a pigment dispersent consisting of a sodium salt of polymethacrylic acids containing approximately 30 percent solids and is manufactured by Rohm nd Haas Company.

The TK-100 is a fungicide consisting of 2 – (4 - thiazolyl) - benzemidazole manufactured by Merck and Co.

The Rhoplex AC-61 has been identified above.

The Merbac 35 is a preservative consisting of benzobromoacetate manufactured by Merck and Co.

The Duramite is a water wash limestone manufactured by Thompson - Wieman Co.

The Rhoplex B-85 is hard acrylic emulsion polymer manufactured by Rohm and Haas Company. It contains 37.5 – 38.5 solids and has a pH of 9.5 – 10.0. It weighs 8.8 pounds per gallon, is anionic, has a minimum film forming temperature which is greater than 90° C., and it has an ultimate clear film hardness of 18.0 on the Tukon scale. Similar compositions are disclosed in U.S. Pat. No. 2,795,564.

The tint can be any of the above enumerated substances or others as required.

For both the prime coat and the topcoat, the various components are added in the above listed sequence to the water base at ambient room temperature and suitably mixed.

The prime coat mixture is applied to the dry board preferably by spraying in the amount of about 8.0 – 9.0 grams per square foot to yield an one mil dry film. The prime coat is applied to preheated boards having a temperature of between about 110° F.–125° F., and the board is immediately inserted into an oven having a temperature of about 200° F.–220° F. and the prime coat will partially dry in about two minutes to form a dry base coat. There is a light penetration of the prime coat into the board to enhance the bond therebetween. The prime coat acts as a sealant to give uniform coverage to the topcoat which is applied to the prime coat.

The above topcoat base mixture is combined with coloring and a polyethylene wax emulsion to form the topcoat mixture as follows:

| Material | Amount in Lbs. |
|---|---|
| Topcoat base mixture | 275.0 |
| Stabiloid Yellow Oxide | 0.15 |
| Stabiloid Chrome Oxide Green | 0.10 |
| CALINK Raw Umber | 0.125 |
| POLYEM 12 Emulsion | 16.000 |

Other suitable colors may be substituted or the topcoat may be clear by not adding colors.

The topcoat is applied in the amount of between about 13–15 grams per square foot to give a two mil dry film, so that the total thickness of the coating system is about 3 mils before the board is compacted. The topcoat is applied preferably by spraying when the board and the prime coat have a surface temperature of about 110° F. The board with the topcoat thereon is then dried in a post heat oven at a temperature of between about 250° F.–375°F. for a period of between about 1 to 1 ½ minutes.

As noted above, the board and the primer-topcoat system thereon is then pressed in a platen press as noted above in Example VIII. However the thickness of the primer-topcoat coating system having an original thickness of about three mils before compaction now varies in thickness between about 1 mil at the points of greatest compaction to about the full 3 mils at the points of least compaction. While the thickness of the coating thus varies between the above limits, it is to be noted that it retains its continuous nature to provide complete sealing at the entire surface of the board.

The topcoat and prime coat discussed above must have enough transparency to permit the tonal effect to show through.

The Paperbestos-Fiber No. 3 listed in Example XII is a spicule-free and highly open grade of asbestos of the Canadian chrysotile variety which contains no fiber spicules or crudy. It has a Rotap screen analysis wherein the weight percentage on a Tyler screen series with a 100 grams for ten minutes is as follows:

| | |
|---|---|
| +10 mesh | 15% |
| 10–14 mesh | 22% |
| 20 mesh | 28% |
| 35 mesh | 24% |

-continued

| | |
|---|---|
| 65 mesh | 3% |
| −65 mesh | 8% |

The surface area of the Paperbestos-Fiber in Centimeter square per gram measured by the rapid surface air system or the Dyckerhoff method is between 18,200 and 22,300. The Paperbestos-Fiber No. 3 is a product of the Johns Mansville Company Ltd.

What is claimed is:

1. A method of making a board having a design impressed on the surface thereof with the design having a tonal effect with portions of different darkness comprising the steps of wet-forming a board from a mixture of a resin binder and reinforcing fibers and filler materials, drying the wet-formed board so as to remove substantially all the water therefrom, heating the dried wet-formed board within a predetermined range of elevated temperatures, pressing said board within said elevated temperature range to increase the reinforcement material resin bond, and impressing a design into said board by compacting the heated dried wet-formed board different amounts by a press element having a design surface within said elevated temperature range to cause the portions which were compacted greater amounts to have a darker coloration than the portions which were compacted lesser amounts solely as a result of compacting said board said different amounts, with the coloration of each portion extending uniformly throughout the thickness of the board.

2. A method of making a board as set forth in claim 1 including the step of applying a polyethylene wax-acrylic emulsion cotig on said board prior to compacting said dried wet-formed board.

3. A method of making a board as set forth in claim 1 wherein a portion of the board is compacted to at least 70 percent of the original thickness of the dry blank.

4. A method of making a board as set forth in claim 1 wherein portions of the board are compacted to at least between about 50 and 70 percent of the original thickness of the dry blank.

5. A method of making a board as set forth in claim 1 wherein portions of the board are compacted to between about 30 and 70 percent of the original thickness of the dry blank.

6. A method of making a board as set forth in claim 2 wherein the applying of said coating includes applying an acrylic emulsion polymer prime coat mixture to a preheated board and drying said prime coat and thereafter applying a polyethylene wax topcoat to a heated board and drying said topcoat at an elevated temperature.

7. A method of making a board as set forth in claim 4 wherein said compacting is effected at a pressure of between about 600 psi and 1500 psi.

8. A method of making a board as set forth in claim 4 wherein said heating of said dried board is at a temperature range of between about 275° F. and 350° F.

9. A method of making a board as set forth in claim 4 wherein said resin binder is present in an amount of between about 10 to 45 percent by weight and said reinforcing fibers and said filler materials are present in an amount of between about 90 to 55 percent by weight.

10. A method of making a board as set forth in claim 8 wherein said resin binder is present in an amount of between about 10 to 45 percent by weight and said reinforcing fibers and said filler materials are present in an amount of between about 90 to 55 percent by weight.

11. A method of making a board as set forth in claim 10 wherein said compacting is effected at a pressure of between about 600 psi and 1500 psi.

12. A method of making a board as set forth in claim 1 wherein said compacting is effected at a pressure of between about 600 psi and 1500 psi.

13. A method of making a board as set forth in claim 12 wherein said resin binder is present in an amount of between about 10 and 45 percent by weight and said reinforcing fibers and said filler materials are present in an amount of between about 90 to 55 percent by weight.

14. A method of making a board as set forth in claim 13 wherein said heating of said dried board is at a temperature range of between about 275° F. and 350° F.

15. A method of making a board as set forth in claim 14 wherein a portion of the board is compacted to at least 70 percent of the original thickness of the dry blank.

16. A method of making a board as set forth in claim 14 wherein portions of the board are compacted to between about 30 and 70 percent of the original thickness of the dry blank.

17. A method of making a board as set forth in claim 1 wherein said resin binder is present in an amount of between about 10 to 45 percent by weight and said reinforcing fibers and said filler materials are present in an amount of between about 90 to 55 percent by weight.

18. A method of making a board as set forth in claim 17 wherein said heating of said dried board is at a temperature range of between about 275° F. and 350° F.

19. A method of making a board as set forth in claim 18 wherein portions of the board are compacted to between about 30 and 70 percent of the original thickness of the dry blank.

20. A method of making a board as set forth in claim 4 wherein said elevated temperature range is between about 300° F. to 340° F.

* * * * *

UNITED STATES PATENT OFFICE

CERTIFICATE OF CORRECTION

PATENT NO. : 3,954,555

DATED : May 4, 1976

INVENTOR(S) : Donald R. Kole and Walter E. Voisinet

It is certified that error appears in the above-identified patent and that said Letters Patent are hereby corrected as shown below:

Column 3, line 19, change "have" to --having--.

Column 4, line 6, change "of" to --or--.

Column 5, line 59, before "form" insert --which--.

Column 9, line 18, change "with" to --was--.

Column 16, line 54, change "nd" to --and--.

Column 18, line 34 (claim 2), change "cotig" to read --coating--.

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*